US005137315A

United States Patent [19]

Bontempo

[11] Patent Number: 5,137,315

[45] Date of Patent: Aug. 11, 1992

[54] GOLF BALL RETRIEVER

[76] Inventor: Angelo Bontempo, 19426 Riverview Ave., Rocky River, Ohio 44116

[21] Appl. No.: 664,937

[22] Filed: Mar. 5, 1991

[51] Int. Cl.[5] ..... A63B 47/02

[52] U.S. Cl. ..... 294/19.2; 294/51

[58] Field of Search ..... 294/19.2, 53.5, 51, 294/52, 59; 403/390, 391, 400

[56] References Cited

U.S. PATENT DOCUMENTS

| | | | |
|---|---|---|---|
| 1,777,809 | 10/1930 | Smith | 294/53.5 X |
| 1,784,108 | 12/1930 | Pearson | 294/51 |
| 3,041,574 | 6/1962 | Cornell, Jr. | 403/400 X |
| 3,614,149 | 10/1971 | Clark | 294/51 X |
| 3,717,371 | 2/1973 | Halone | 294/19.2 |
| 4,597,690 | 7/1986 | Girard | 403/391 |
| 4,730,859 | 3/1988 | Gabinet | 294/19.2 |

*Primary Examiner*—Margaret A. Focarino
*Assistant Examiner*—Dean J. Kramer
*Attorney, Agent, or Firm*—J. Helen Slough

[57] ABSTRACT

A golf ball retriever comprising a rake attachment, spring pressed clamp for securing a handle, shaft, pole, rod or conventional retriever to the rake attachment, said clamp permitting the rake attachment to be moved into different angled positions relative to the shaft, rod, pole, or the like.

1 Claim, 4 Drawing Sheets

GOLF BALL RETRIEVER

FIELD OF THE INVENTION

This invention relates to a rake device for use in retrieving golf balls from water hazards and other highly inaccessible areas or the like and relates more particularly to a rake device which may be attached to any retriever, golf club, rod or the like.

DESCRIPTION OF PRIOR ART

Various devices for scooping or raking golf balls from water hazards or other inaccessible areas have been known. U.S. Pat. No. 4,254,981 issued Mar. 10, 1981 to Wilson discloses a rake with a plurality of retrieving fingers. Although the Wilson rake purports to be an improvement over U.S. Pat. No. 2,738,214 issued Mar. 13, 1956, to Zimmers, which often drops the golf ball when the same is lifted from the hazard. Although Wilson purports to ban improvement over the Zimmers' structure, the Wilson device will also occasionally drop the golf ball. Other devices with fingers to grasp the ball, such as U.S. Pat. No. 3,306,650 issued Feb. 28, 1967 to Zagwum and U.S. Pat. No. 4,046,413 issued Sep. 6, 1977 to Jeniga presents the same problem.

The present inventor is the patentee of U.S. Pat. No. 4,957,319 granted Sep. 18, 1990 which discloses a rake attachment which eliminates the occasionally dropping of a golf ball carried thereby and represents an improvement over the rake-type golf ball retrievers of the prior art. The present inventor has further improved his design of the rake-type retrievers of U.S. Pat. No. 4,957,319 enabling the same relatively easier to store when not in use, inexpensive to manufacture, and for disposition at different selected angles for retrieving golf balls.

SUMMARY OF THE INVENTION

The present invention is an improvement over the inventor's above-referred to patent. In the present invention spring pressed clamping means are employed for attaching the rake to a club shaft, a rod, a retriever or the like. The said spring pressed clamping device allows the rake to be swivelled 90 degrees wherefor the rake can be carried parallel to the rod or shaft easier to store in a golf bag carrying the clubs.

The rake attachment of the present invention secures the golf ball securely in place and presents the same from falling out of the rake before the golfer removes the same therefrom. Most golfers carry a ball retriever in their golf bag. The present rake attachment can be attached to said ball retriever and thus enables the use of the rake attachment on a golf shaft, a rod, or the like to constitute a handle for a rake-like retriever or on an existing golf ball retriever. It is proposed that if the rake attachment of the present invention is attached to a conventional single golf ball retriever, it will not hinder the use of said single golf ball retriever when the same is needed. For instance, when the golf ball is located among rocks, the single golf ball retriever may be easily used.

The rake attachment of the present invention is provided with a means for seating and retaining a golf ball. The invention further has the capability of retrieving more than one golf ball at a time, and is adapted to be attached to the retriever carried in a golf bag along with clubs, and can be easily swivelled 90 degrees to an upright position for easy storage in the golf bag with the clubs after using.

In the past, when golfers attempted to retrieve a golf ball from a water hazard the golfers usually could not see the golf ball because it was suspended in soil and other material in the water and/or reflection of the rays passing through the air-water interface.

The rake attachment of this invention enables a golfer to retrieve his balls from a hazard without visual hindrance and with greater ease than with prior retrievers. When the present rake is pulled through the water in the general area of the golf ball, the golfer using the same can actually feel a golf ball dropping into the attachment as a result of the tactile cues which vibrate through the shaft to which it is attached. Additionally, the device is adapted to better trap a lost golf ball and any surrounding stray golf balls than devices of other dimensions and/or restrictive openings as in U.S. Pat. No. 3,717,371 issued Feb. 20, 1973 to Halone. The above and other objects and advantages of the present invention will become more readily apparent from a purview of the following detailed description as appended hereto, in which reference is made to the accompanying drawings.

IN THE DRAWINGS

FIG. 4 is an end view of the golf ball retriever of FIG. 1 showing the same clamped to a shaft of a conventional golf ball retriever swivel as positioned for storage in a golf bag or the like.

DETAILED DESCRIPTION OF THE PREFERRED EMBODIMENT

Figure 1:
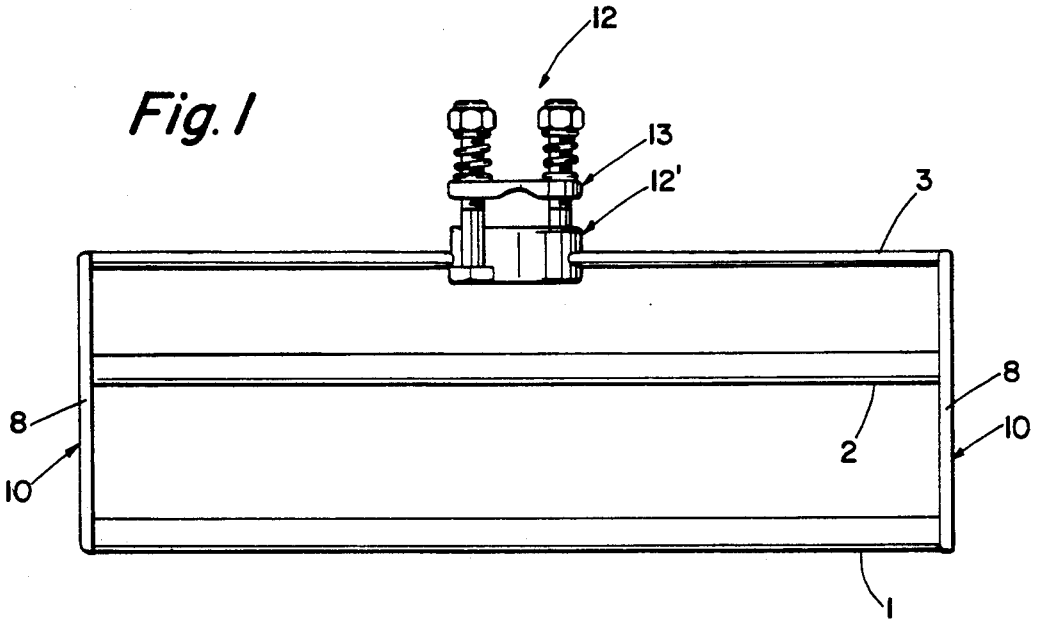
FIG. 1 is a front view of the golf ball retriever of this invention.
Figure 2:
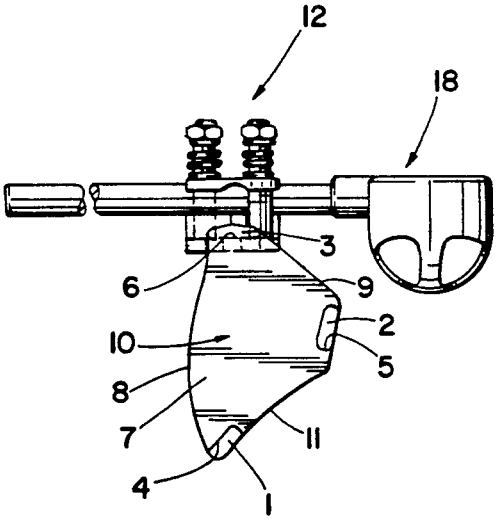
FIG. 2 is the side view of the golf ball retriever of FIG. 1 showing the same attached to the shaft of a conventional golf ball retriever.

Referring now more specifically to the drawings, in all of which like parts are designated by like reference characters, and more particularly to FIG. 1, the rake attachment of this invention comprises elongated parallel spaced horizontal bars 1, 2, 3 secured preferably to the outer opposite ends of end plates 7 preferably by projecting the ends of rods 1, 2, an 3 respectively through openings 4, 5, 6 in pairs of the oppositely disposed end plate 10 and the said rods or bar members 1, 2 and 3 are secured by reaming the ends of the members over the plate surface surrounding the openings or by riveting the same thereto, or by die casting or other fastening means. The bars 1, 2, and 3 as shown are rectangular in form and in the preferred embodiment the width of bar 1 is approximately three times that of its thickness. The width of the bar 2 it will be noted in the preferred embodiment is slightly smaller than the bar 1 and is of similar thickness. Bar 3 is also rectangular in shape with its thickness approximately the same as bars 1 and 2 and its width is approximately ½ inch. The end plates are preferably as shown, flat rectangular or triangular plates each having a pair of curved sides 8 and angular sides 9 and 10. The curved side 8 is a compound S-like curve with a lower section being curved outwardly and the upper section curved inwardly as shown in FIG. 2. The side 10 is curved inwardly. In FIG. 2 the bar is shown attached to the end plate 7. At the intersection of the curved side 8 and 10 the bar 1 is attached to the end plates 7 as shown in FIG. 2. At the intersection of the curved side 8 and angular side 9 the bar 3 is attached to the end plate 7, as shown in FIGS. 1 and 2.

Figure 3:
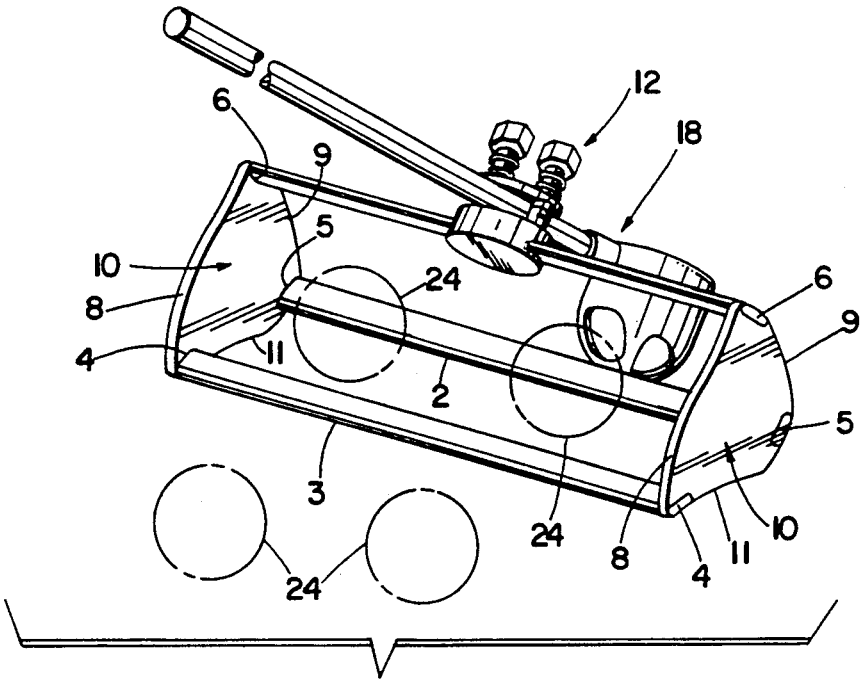
FIG. 3 is a perspective view of the golf ball retriever of this invention showing two golf balls retained within the retriever clamped to a portion of a conventional golf ball retriever shaft.
Figure 5:
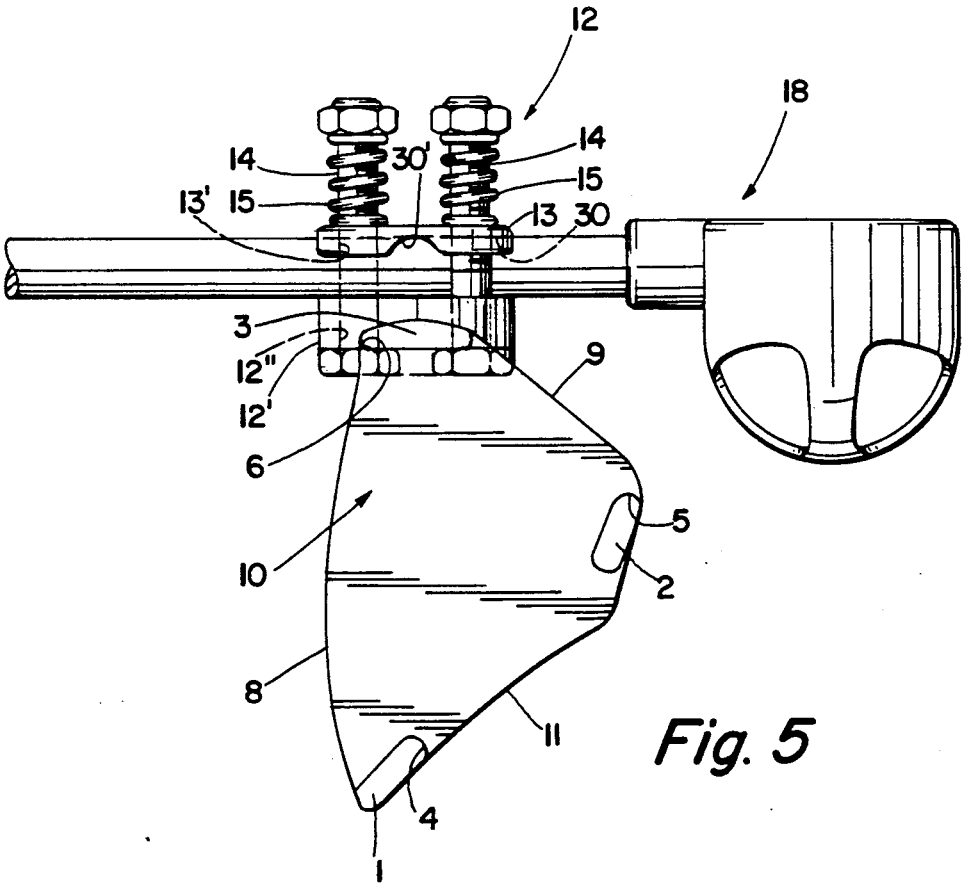
FIG. 5 is a side view of the invention.
Figure 6:
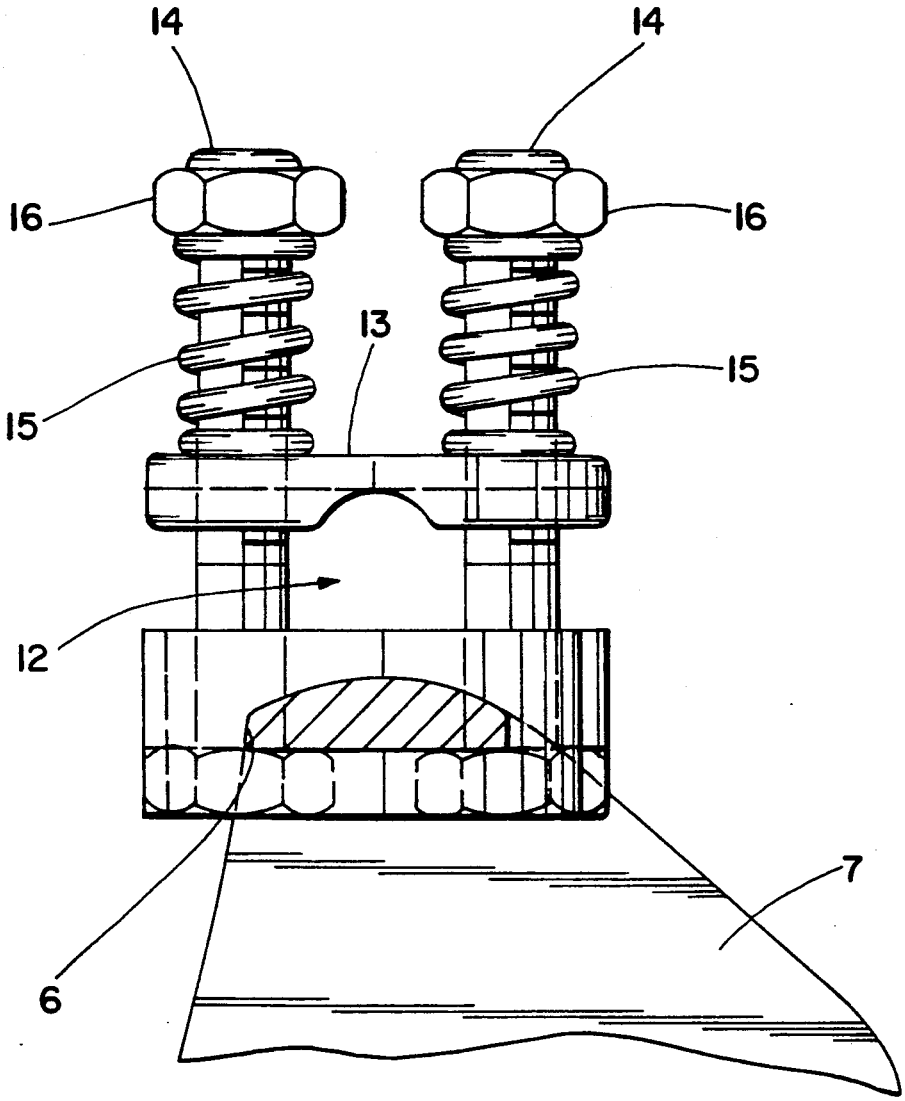
FIG. 6 is an enlarged view of the clamping means of FIGS. 1 to 5.

The space provided between 1 and 2 and the space between bar 2 and 3 is selectively less than the diameter of a golf ball and the space between bar 1 and 3 is substantially larger than the diameter of a golf ball, wherefor when the rake, is clamped to a handle means, such as a shaft of a conventional golf ball retriever 18 as shown in FIGS. 2, 3, 4, and 5, or to a pole or the like, by clamping means 12, a ball or balls 24 would be retrieved and retained within the pocket thereof provided by the space between rods 1, 2, and 3, as shown in FIG. 3. The golf ball or balls 24 when entrapped by the rake retriever thus easily moves over the leading rod 1 and into a pocket provided by the spacing between the rods. The top rod 3 prevents, as shown in FIG. 3, the ball or balls 22 from egression through space between rods 2 and 3 when the ball is recovered from water, tall grass or other inaccessible areas where the same was located and into which area the rake was inserted. The back rod 2 prevents a golf ball captured by the rake from egress through the space between the rods 1 and 2. Each of the opposing end plates 7, as stated hereinbefore, are provided with a curved leading surface 8 which enables the rake to slide easily over any projecting ledge or obstacle under the water and prevents the same from being "snagged" by any obstruction under the water.

Figure 4:
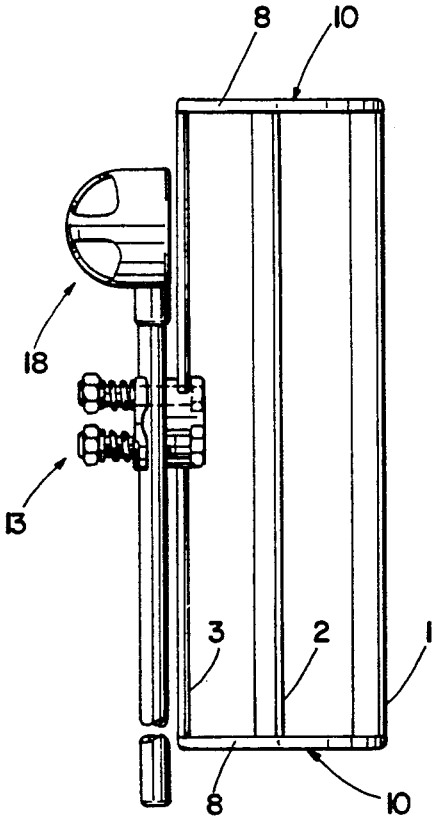
Figure 7:
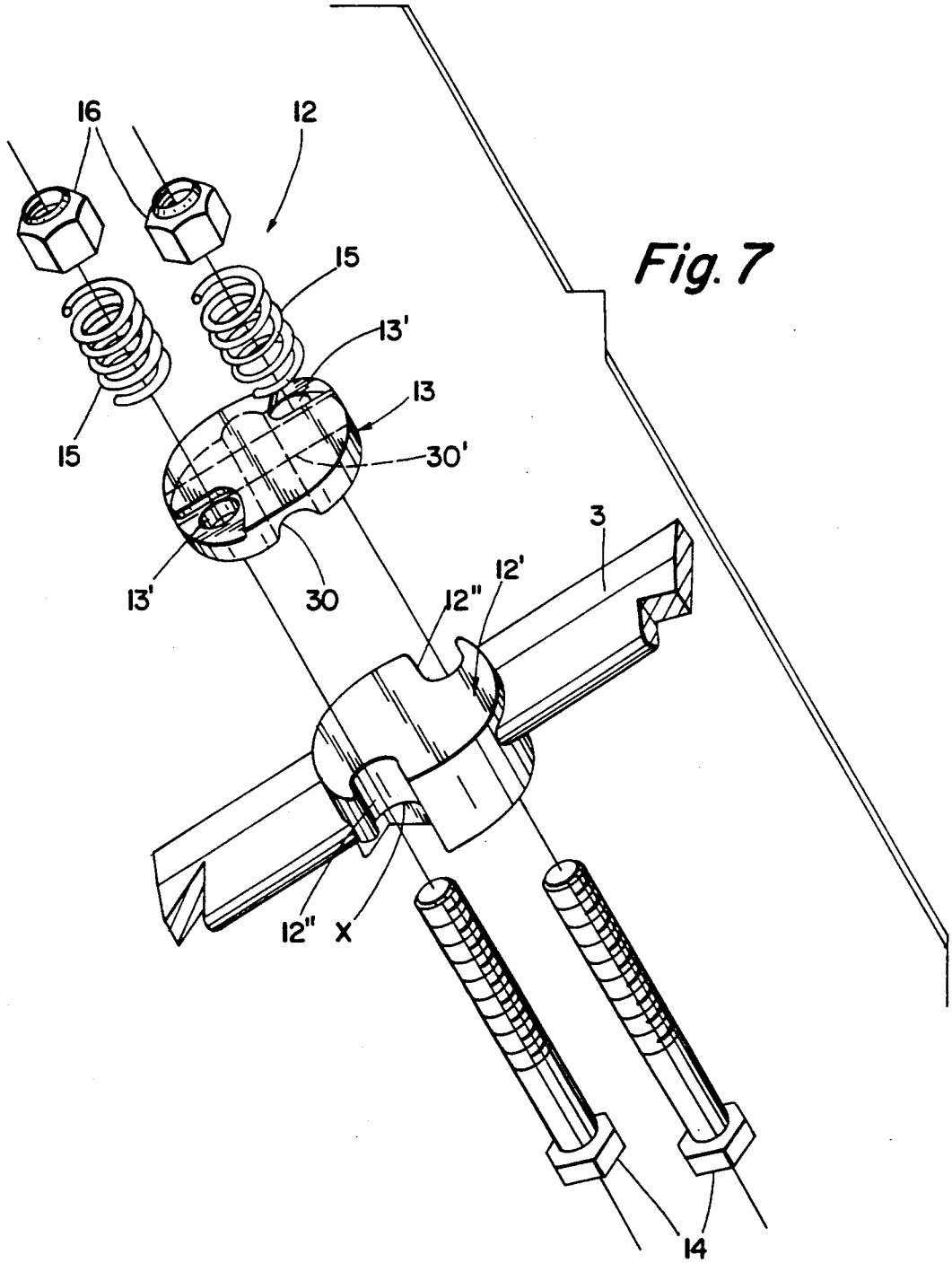
FIG. 7 is an exploded view of the clamping means of FIGS. 1 to 6 inclusive.

FIG. 7 shows an exploded view of the clamping device of this invention. The clamping device is comprised of two bolts 14 which pass through openings above a plate which is attached to the rod 3, as shown in FIGS. 1, 3, and 4. In the preferred embodiment the plate 12 is elliptical and the openings are at the edge of the plate 12 and do not fully surround the bolt. Also the bottom of the plate 12 is cut out at "X" so that the heads of the hex-bolts 14 used in the preferred embodiment of FIG. 7 will seat in the cut-out portions "X" and will be unable to be turned when seated. A top plate 13 is provided with two openings 13' for the ends of the hex-bolts. The top plate in the preferred embodiment is also elliptical in shape as shown. On the bottom side of the top plate 13 in the preferred embodiment two grooves 30 and 30' are provided which run at 90 degree angles to each other. The bolts 14 pass through the top plate 13 and springs 15 are placed over the threaded ends 14 of the bolts projected through the openings 13' of the top plate. Nuts 16 are threaded onto the end of the bolts 14 and compress the springs 15. In operation a shaft or rod is placed between the bottom plate 12 and top plate 13 in one of the two grooves 30 or 30'. The bolts 14 are thus tightened, and the springs hold the shaft or rod snugly in place in the selected groove. The springs are tightened just snugly enough to hold a golf shaft, rod or retriever rod securely in place but also permits it to be moved from one of the grooves 13 to position it into the other groove 13' or vice versa. This enables the shaft or rod, etc. to be placed in a position similar to the adjusted positions of FIGS. 3 and 4. In FIG. 3 the shaft is shown in position for use in retrieving golf balls. In FIG. 4 the shaft is shown moved to a groove 90 degrees opposed to the groove in which the rod is seated in FIG. 3 thus aligning the rake with the shaft or the like ensuring a more easily storable position of the rake.

Although but one embodiment of this invention has been illustrated and described, it is to be understood by one skilled in the art that numerous and extensive changes and modifications may be made therein without however departing from the spirit of the claimed invention. Accordingly, the scope is intended to be limited only by the scope of the appended claims.

What is claimed is:

1. A rake-like retriever for golf ball or balls wherein the retriever comprises:

a. a bottom plate with two openings therethrough;

b. a pair of bolts adapted to fit through the openings in the bottom plate;

c. a top plate having a pair of openings therein adapted to allow said bolts to pass through the openings in said top, said bottom plate having cut-outs into which the head of said bolts is seated;

d. the bottom of said top plate having a pair of grooves on the bottom of said plate at right angles to each other;

e. spring means adapted to fit over each of said bolts;

f. nuts adapted to fit on the threaded ends of the bolts; and g. a handle sandwiched between the said bottom plate and the said top plate, said handle adapted to be fitted into either one of the grooves on the bottom of the top plate, said bolts passing through openings in the bottom plate passing through an opening in the top plate, said springs then being placed over said bolts and the bolts tightened whereby under spring pressure the handle is held snugly between the top and bottom plates but able to be moved from one groove to the other.

* * * * *